United States Patent [19]

Kindig

[11] 4,322,915

[45] Apr. 6, 1982

[54] APPARATUS FOR BEVELING GLASS

[76] Inventor: Morris L. Kindig, 255 S. Rengstorff, Mountain View, Calif. 94040

[21] Appl. No.: 149,029

[22] Filed: May 12, 1980

[51] Int. Cl.[3] ..... B24B 9/10

[52] U.S. Cl. ..... 51/3; 51/102; 51/128; 51/283 E

[58] Field of Search ..... 51/3, 128, 102, 283 E, 51/109, 110

[56] References Cited

U.S. PATENT DOCUMENTS

| | | | |
|---|---|---|---|
| 1,259,494 | 3/1918 | Downer | 51/3 |
| 2,000,667 | 5/1935 | Osterholm | 51/109 |
| 2,944,374 | 7/1960 | Persson | 51/110 |
| 2,948,088 | 9/1960 | Jepson | 51/3 X |
| 3,981,105 | 9/1976 | Flaherty | 51/109 R |
| 4,053,288 | 10/1977 | Barron | 51/128 |

*Primary Examiner*—Nicholas P. Godici
*Attorney, Agent, or Firm*—Thomas E. Schatzel

[57] ABSTRACT

An apparatus for beveling the edges of glass including a base, an exterior case mounted on the base containing a pair of electrical motors, the motors respectively rotating a pair of beveling spindles which extend an adjustable distance through a pair of apertures in the top surface of the case so as to contact and bevel the glass. Mounted above the base at the back exterior of the case is a further electrical motor for directly driving two rotating wheels, a lustering wheel and a polishing wheel. The case further contains a fluid reservoir and tubes for delivering water or wetting agent to the surface of the beveling spindles and switching and electrical circuitry for controlling the three electrical motors and fluid delivery system.

17 Claims, 6 Drawing Figures

APPARATUS FOR BEVELING GLASS

BACKGROUND OF THE INVENTION

1. Field of the Invention

This invention relates generally to grinding and shaping apparatus, and more particularly to apparatus for shaping and polishing non-molten glass.

2. Description of the Prior Art

The material known as "glass" is in reality a supercooled liquid. It is extremely malleable and may be easily formed into nearly any shape when it is heated to softening or molten points. However, when glass is allowed to cool, it frequently becomes extremely brittle since it does not form a cohesive crystalline structure as do true solids. These properties make glass a very easy material to work with while molten or at high temperatures, but make it fragile and difficult to work with at normal atmospheric temperatures.

Since it is frequently necessary to perform various operations on glass at normal temperatures, it is necessary to derive methods for performing these operations which minimize the danger of chipping, shearing, or shattering the material. Not all operations can take place with the molten glass. Some of these involve the smoothing out of irregularities, the polishing of the glass surface, and particularly in the instance of special-purpose glass, the forming and modifying of sections for optical and spectral reasons.

The art of making beveled glass objects such as windows, lampshades, and displays, has become extremely popular in recent years. Enrollment in classes teaching persons how to work with beveled glass has jumped substantially and the interest in the art has reached a very high level.

The majority of prior art attempts to provide means for beveling and polishing glass have been in the nature of abrasive surfaces, either stationary surfaces against which the particular piece of glass is rubbed, or moving surfaces such as a belt sander or a rotating grindstone. Various modifications have been made in order to attempt to minimize the danger of damage to the glass surface. Efforts have been particularly notable in the fields of mirror and lends grinding. Examples of prior art means of beveling or grinding a cooled glass surface are demonstrated in U.S. Pat. No. 1,664,300 issued to B. F. Kelly, U.S. Pat. No. 852,626, issued to C. Schwartz and J. Bortzner, and in German Pat. No. 2250052.

The prior art has paid scant attention to machines or methods for effectively beveling a glass surface. The term "beveling" as used in relation to glass means to take a sheet, workpiece or pane of glass of a certain thickness and to gradually taper the thickness of the sheet towards the edges such that the edge portion of the pane is thinner than the central portion. This beveled edge creates an aesthetically pleasing form for art glass. The tapered surface junction with the flat surface also creates a light diffraction through the glass resulting in a light scattering spectral array.

SUMMARY OF THE INVENTION

It is therefore an object of the present invention to provide an improved apparatus for beveling a glass sheet.

It is another object of the present invention to provide an apparatus wherein the entire process of beveling a glass sheet from rough beveling to polishing can be accomplished on the same apparatus.

It is another object of the present invention to provide an apparatus for beveling glass in which the width of the bevel may be easily altered.

Briefly, the preferred embodiment of the present invention is an apparatus for beveling glass at normal room temperatures. The apparatus includes a rectangular base. An exterior case, in the general shape of a tapered rectangular solid, is integrally mounted on the base. A pair of AC/DC direct drive motors are contained within the case. Each motor drives a grinding or beveling spindle. The spindles partially extend upward through a pair of apertures in a plate which forms the top surface of the case. The beveling spindles are mounted on shafts extending out of the motor in such a manner that they may be adjusted so that they extend varying distances above the edges of the apertures in the case top. The interior of the case further includes a wetting agent reservoir and a pump for delivering wetting agent through a system of delivery tubes to the grinding surface of the beveling spindles as well as a runoff reservoir for receiving wetting agent from the spindles. The controls for the two AC/DC grinding motors are mounted on the front surface of the case. Extending backward from the top of the back of the case is a shield. This shield extends over a third electrical motor which is mounted on the back of the case and disposed above the base so as to have its long axis parallel to the plane of the base. This motor has a shaft extending from each end, one end of the shaft extending to a lustering wheel having a fine abrasive mounted thereon for lustering of the glass and the other end having a polishing wheel mounted thereon.

It is an advantage of the present invention that the entire beveling process, from rough beveling through fine beveling, lustering and final polishing, is accomplished by a single apparatus.

It is another advantage of the present invention that the beveling spindles are adjustable with respect to the flat upper surface of the top of the case such that the beveling spindles may be adjusted up or down to control the width of bevel of the particular sheet of glass.

It is a further advantage of the present invention that the beveling spindles are shaped and provided with abrasive surfaces in such a manner that the edge of the glass surface is finished at the same time that the bevel is being induced.

It is yet another advantage of the present invention that the design of the beveling spindle is such that the interior edge of the bevel will always follow the exterior edge of the glass in straight line or curvature form These and other advantages of the present invention will become apparent after reading the following detailed description of the preferred embodiment which is illustrated in the several figures of the drawing.

IN THE DRAWING

DETAILED DESCRIPTION OF THE PREFERRED EMBODIMENT

Figure 1:
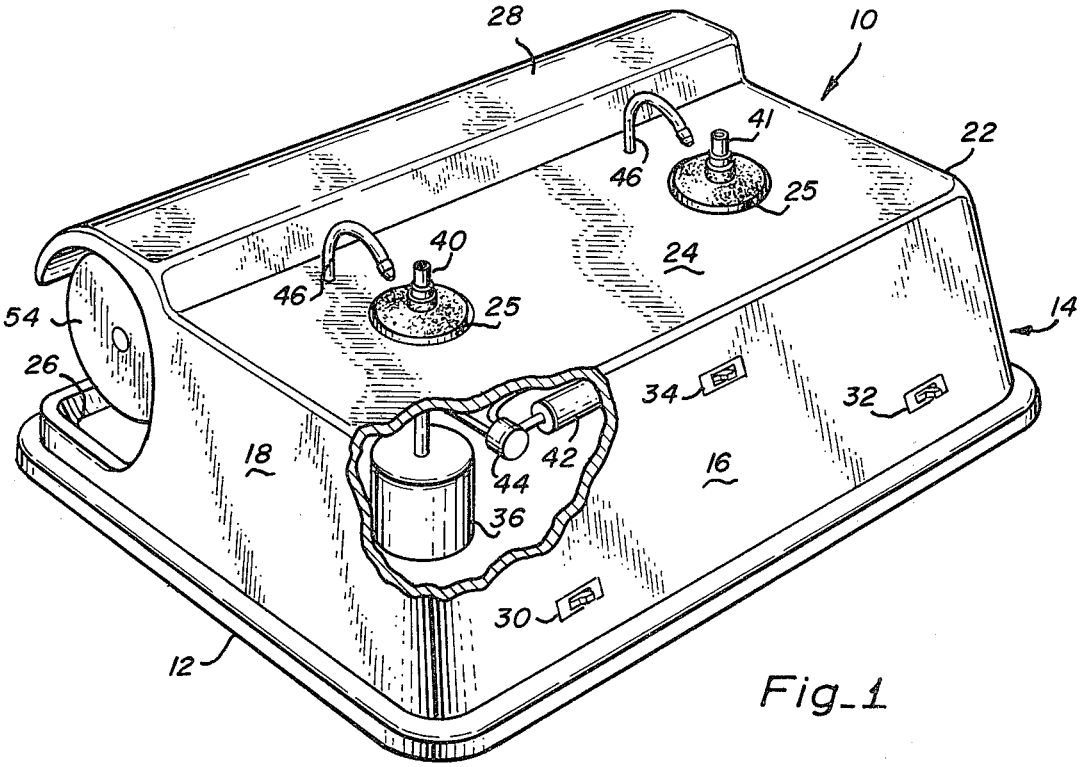
FIG. 1 is a perspective view of an apparatus for beveling glass in accord with the teachings of the present invention.

The present invention is a glass beveling apparatus referred to in the drawing by the general reference character 10. The apparatus 10 functions as a single work station for beveling a pane of plate glass or any similar substance.

Figure 2:
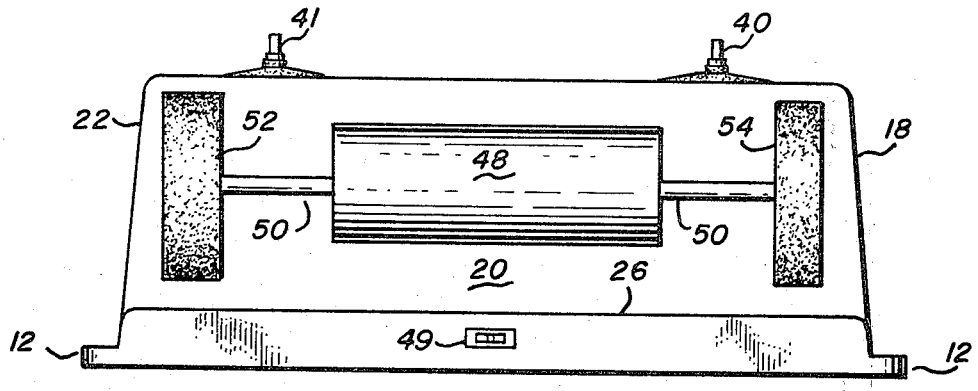
FIG. 2 is a back plan view of the beveling apparatus with the safety shield removed.

As particularly illustrated in FIGS. 1 and 2, glass beveler 10 includes a rectangular base 12 upon which is mounted an integrally formed case 14 in the shape of a tapered rectangular solid. Case 14 is hollow and is integrally constructed of a front panel 16, a left side panel 18, a back panel 20, a right side panel 22. A top panel or table top 24 is mounted upon case 14. Table top 24 includes a pair of apertures 25. Situated at the lower back of casing 14 and integrally formed therewith so as to be contiguous with base 12 is a back ledge 26. Extending outward and backward from the top back surface of casing 14 is a safety shield 28.

The shape of casing 14 is such that table top or plate 24 is parallel to the base 12 while the back panel 20 is perpendicular to base 12 and table top 24. Front panel 16, left side panel 18, and right side panel 22 are inclined inward from bottom to top.

Front panel 16 includes a first electrical switch 30, a second electrical switch 32, and a master on-off switch 34. Switches 30, 32, and 34 control the electrical motors within the case 14. In FIG. 1, the front panel 16 is partially cut away to show a first electrical motor 36 contained within the left hand portion of casing 14. Casing 14 also includes a second electrical motor 38, substantially similar to motor 36, in the right hand portion thereof. Situated directly above and connected to the motor 36 is a first beveling spindle 40. A second beveling spindle 41 is similarly situated above and connected to the motor 38. Beveling spindles 40 and 41 are the elements which actually contact the glass and impart the bevel to the glass surface.

Casing 14 also contains a liquid reservoir 42 which can be seen through the cut away portion of front panel 16 in FIG. 1. A fluid pump 44 transports water or another wetting agent from the liquid reservoir 42 through a system of delivery tubes 46 to the abrasive surfaces of beveling spindles 40 and 41. The system of delivery tubes 46 extend through the case 14 and the ends are supported above the rear halves of spindles 40 and 41. During operation of the apparatus 10 on a piece of glass, it is desirable to deliver water or another wetting agent to the surface of spindles 40 and 41 such that the abrasive surfaces are maintained in a wet condition during the grinding process. If the surfaces are allowed to dry out, the chances of either the glass or the grinding material chipping, breaking, or otherwise becoming irregular are greatly increased. The addition of water or a similar wetting agent promotes smooth grinding and beveling by acting as a lubricant between the abrasive surface of spindle 40 and the glass. The wetting agent further acts to cool the abrasive surface such that no irregularities are caused in the process by the overheating the glass surface to the extent that it fractures.

In FIG. 2, the safety shield 28 is omitted to more clearly show the arrangement of the finishing portion of the apparatus 10. Mounted on the back panel 20 of the casing 14 is a finishing motor 48. Finishing motor 48 is situated such that its longitudinal axis is parallel to the plane of base 12 and that it is supported above back ledge 26. A finisher switch 49, similar to switches 30, 32 and 34 on the front panel 16 and situated on the back ledge 26 operates motor 48. Extending outward from the ends of finisher motor 48 is a continuous finisher shaft 50. On one end of finisher shaft 50 is mounted a lustering wheel 52. Lustering wheel 52 is a cork wheel coated with a fine grained abrasive, usually pumice, for providing a semi-polished surface on the glass work piece. Situated about the other end of shaft 50 is a polishing wheel 54. Polishing wheel 54 is felt, coated with ultra-fine abrasive particles, usually cerium oxide, which is used to buff polish the glass when the lustering process is completed.

Figure 3:
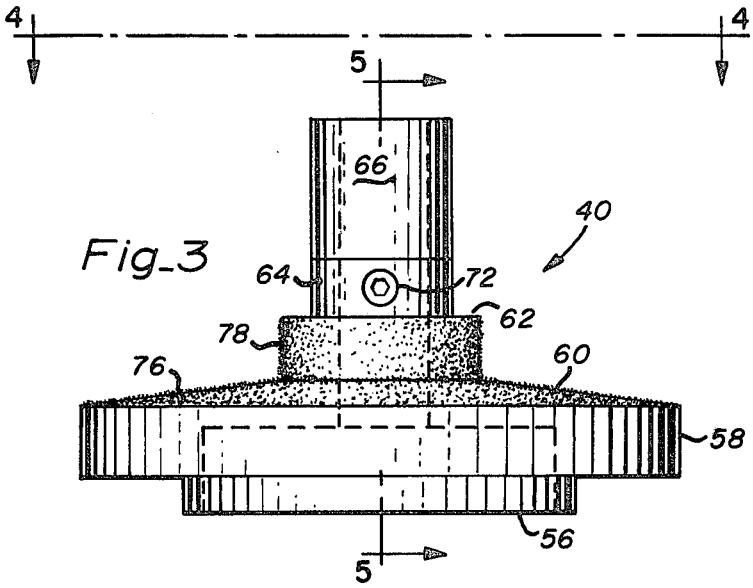
FIG. 3 is a side view of a beveling spindle.
Figure 4:
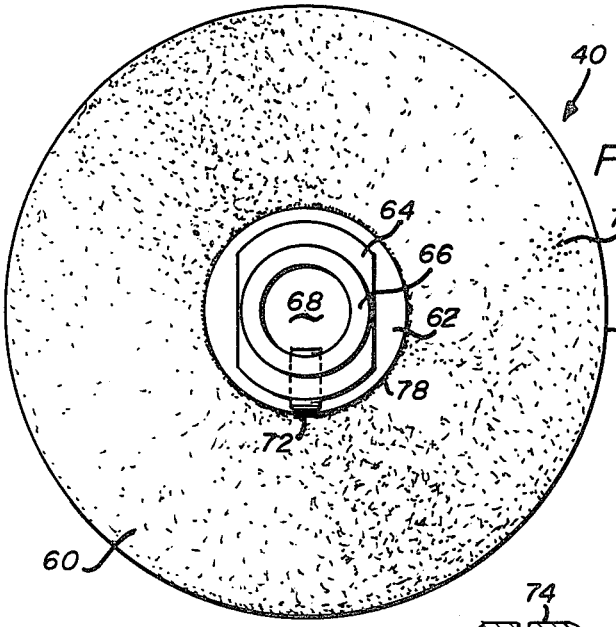
FIG. 4 is a top plan view of the beveling spindle.
Figure 5:
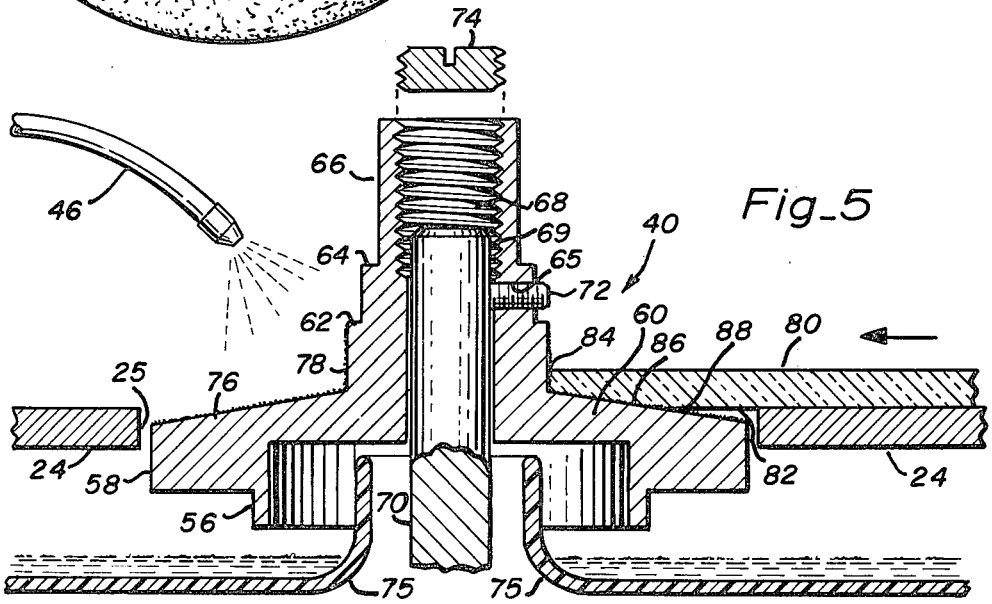
FIG. 5 is a cross-sectional view, taken along line 5—5 of FIG. 3, showing the beveling spindle in relation to a glass work piece and the elements of the apparatus.

A beveling spindle 40, as used in the present invention, is illustrated in detail in FIGS. 3, 4 and 5. Spindle 40 is an integrally formed member constructed of a strong substance such as steel. Spindle 40 is shaped to include a number of subsections. Situated about the bottom of spindle 40 is a splashguard ring section 56. Splashguard ring 56, as is shown in FIGS. 3 and 4, extends downward from the main body of spindle 40. This splashguard ring section 56 acts to prevent runoff wetting agent and ground glass from splashing into the drive motor area.

Situated directly above the splashguard ring section 56 and extending outward beyond it is a flywheel ring section 58. Flywheel ring 58 is a solid section which provides balance to the spindle 40 as it is spun. Flywheel ring section 58 also assists in maintaining the rotational angular momentum of the spindle 40 during the grinding process.

Located above flywheel ring section 58 is a beveling cone section 60. Beveling cone 60 is inclined from outside to inside, such that a bevel can be created on a workpiece brought into contact with the outside surface of the cone section. Depending on the particular spindle 40 used, the angle of inclination of beveling cone 60 will vary. The specific inclination utilized is selected by the operator to create the particular angle of bevel desired.

Situated directly above the beveling cone section 60 is a cylindrical edging ring section 62 of considerably lesser diameter than the flywheel ring section 58. The edging ring section 62 is cylindrical and extends above the beveling cone section 60.

Directly above edging ring section 62 is a grip ring section 64. Grip ring section 64 is of generally cylindrical shape with areas on two sides flattened as shown particularly illustrated in FIG. 4. The flattening of the sides of grip ring section 64 allows the spindle 40 to be grasped by a wrench or other implement for turning and machining. A threaded bore 65 is provided through the curved portion grip ring section 64.

Extending upward from grip ring section 64 is a cylindrical stem section 66. The diameter of stem section 66 is less than that of the edging ring section 62 and of the grip ring section 64 and is approximately equal to the distance between the centers of the flattened sides of grip ring 64, (See FIG. 4).

A center bore 68 extends through the spindle 40 about its axis of rotation. The portion of center bore 68 lying within stem portion 66 is threaded to include a number of threads 69. Center bore 68 is adapted such that a drive shaft 70, attached to the electric motor 36, may be coupled to the spindle 40. The drive shaft 70 is coupled to the spindle 40 by means of a threaded lock or set screw 72 inserted into the threaded bore 65.

The height of spindle 40 relative to the table top 24 is controlled by its positioning on the drive shaft 70. The height may be adjusted by turning an adjusting screw 74 within the threading 69 of the center bore 68 such that the interface of the adjusting screw 74 with the end of the drive shaft 70 causes lifting or lowering of spindle 40. The adjusting is made with the lock screw 72 retracted from the shaft 70. Once the desired height of the spindle 40 has been reached, the position is then set by tightening the locking screw 72 against the shaft 70. The tightening of set screw 72 firmly holds the spindle 40 in position on the drive shaft 70 such that a constant height relative to the table top 24 is maintained during the beveling operation.

The splashguard ring section 56 overlaps, without touching, the upper edges of a runoff reservoir 75 which is situated under table top 24 to protect motor 36 from runoff wetting agent. The runoff reservoir 75 receives extra wetting agent and ground glass which is washed off the beveling cone 60 surface. The runoff reservoir is symmetrical about shaft 70 and has raised edges with extend upward inside of splashguard 56 to prevent the runoff wetting agent and contaminants from splashing into the motor area.

Spindle 40 has an abrasive surface 76 about the exterior of the beveling cone portion 60. Beveling abrasive surface material 76 includes diamond particles adhered to the surface of beveling cone 60. The specific texture and grain of beveling abrasive 76 varies from spindle to spindle and is selected depending on the degree of abrasive desired for the particular step in the glass-beveling process. For example, in FIG. 1, the abrasives utilized for the initial beveling step, that is, on the beveling cone 60 surface of first spindle 40 would be of a relatively heavy grade to provide a faster but rougher grinding to the glass surface. Another spindle, e.g. spindle 41 would have a beveling abrasive 76 of a finer grade. Thus, a piece of glass would be first applied to the spindle 40 and then to the spindle 41 if the operator desires to proceed from a rough abrasive to a finer abrasive so that the bevel surface of the glass is gradually smoothed out.

The exterior surface of the edging ring section 62 is provided with an edging abrasive coating 78. The edging abrasive material may be selected to be either a fine or a coarse material. Edging abrasive coating 78 may be of a much finer grain than the beveling abrasive surface 76. Thus, the coating 78 may be used to smooth the peripheral surface of the edge of the piece of glass. Edging abrasive 78 is a diamond particle dispersion which is firmly bonded to the surface of the edging ring 62. The edging abrasive material may be a coarse material if it is desired to use it for grinding and generally shaping the peripheral shape of the piece of glass.

FIG. 5 also illustrates the relationship between the spindle 40 and the table top 24. Once the elevation of the spindle 40 has been adjusted using adjusting screw 74 and secured by set screw 72 upon the shaft 70, the height of the various elements of the spindle 40 with respect to the top surface of table 24 is established. This relationship will remain constant throughout until readjusted. The operator then utilizes the grinding aspects of spindle 40 as shown in FIG. 5. A glass workpiece 80, usually of a planar nature, is placed so as to rest flat against the surface of table top 24. It is then slid forward towards the spindle 40 until it comes in contact with the beveling cone section 60 and consequently the beveling abrasive 76. Since spindle 40 is spinning at high speed, the beveling abrasive 76 quickly abrades down the interfacing surface of the workpiece 80 to form the bevel. Workpiece 80 is arrayed such that its bottom side surface 82 contacts the top of table 24 and its leading edge 84 abuts against edging ring 62 when fully advanced. When such positioning is realized, a bevel 86 is formed by the abrasive action of beveling abrasive 76 on the bottom side surface 82.

The edging ring 62 and edging abrasive 78 performs a dual purpose during this operation. Edging ring 62 provides a stop point against which the operator may hold the glass workpiece 80 such that an even bevel is attained. Edging abrasive 78 simultaneously finishes the edge surface 84 of workpiece 80 to its final configuration.

In order to change the angle of the bevel 86, it is necessary to select a spindle 40 wherein the angle of inclination coincides with the desired angle. However, in order to change the width of bevel 86 while maintaining the same angle, it is only necessary to adjust the height of spindle 40 upon shaft 70. Since the planar orientation of workpiece 80 is determined by the surface of table top 24, adjusting the height of spindle 40 allows the workpiece 80 to come in contact with a greater or lesser portion of the beveling cone section 60 depending on the height selected. The stop position provided by edging ring 62 then insures that the bevel takes place only up to a certain point on the workpiece.

Figure 6:
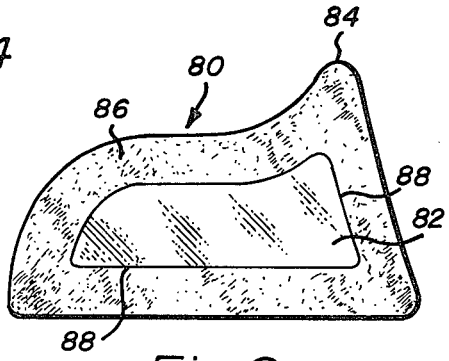
FIG. 6 is a top plan view of an irregularly shaped work piece of plate glass shown as it appears after being beveled by the apparatus of the present invention.

FIG. 6 illustrates a top view of a particularly irregularly shaped workpiece of glass 80. FIG. 6 illustrates an example of the workpiece 80 after it has been beveled in the manner illustrated in FIG. 5, with the outer edge 84 being kept in contact with the edging ring 62 throughout the beveling process. FIG. 6 illustrates that the inner edge 88 of the bevel 86 follows the same contour as the outer edge 84 of the glass. The inner bevel edge 88 maintains a constant separation from the outer edge 84 of the workpiece 80. This result is particularly advantageous to a worker in glass wherein the symmetry of the bevel is the primary objective and provides the greatest amount of beauty.

A typical workpiece beveling operation using the apparatus 10 includes several steps. After selection of the appropriate workpiece 80, the operator would then determine the angle and width of bevel desired. The angle and width of bevel desired would determine the selection and adjustment of first spindle 40. Initially a spindle 40 having the appropriate inclination of beveling cone 60 for the bevel desired would be installed. Then, depending on the width of bevel desired, the height of first spindle 40, that having the coarser beveling abrasive 78, would be adjusted as shown in FIG. 5 to the appropriate height. The operator would activate the master on-off switch 34 and then push first switch 30 so as to simultaneously activate the first electrical motor 36 to spin spindle 40 and the liquid or wetting agent delivery pump 44 to deliver the wetting agent to the surface of spindle 40.

At this point the operator is ready to begin the actual beveling of the glass workpiece 80. The operator places workpiece 80 upon the surface of or table top 24 and slides it toward the spindle 40. The workpiece is gradually brought into contact with spindle 40 such that its rough edges will be gradually ground down by the interface with the abrasive 76. As soon as it is possible to do so while maintaining contact between the bottom surface 82 of the workpiece 80 and the table top 24, the operator urges workpiece 80 forward such that its leading edge 84 comes into contact with edging ring 62. The operator then manipulates the glass workpiece 80 sideways, always keeping the leading edge 84 in contact with the outer surface of the edging ring section 62. The workpiece 80 is manipulated until the entire edge surface desired to be beveled has been ground down uniformly to include a bevel 86. This completes the rough beveling step.

Once the rough beveling step has been completed, the operator proceeds to fine bevel the workpiece 80. In this case the second spindle 41 is utilized. Second spindle 41 is selected to have a beveling cone section 60 of the same angle of inclination and the same relative height with respect to table top 24 as did the first spindle 40.

After ascertaining that these conditions exist, the operator pushes switch 32 which performs the same function for second electrical motor 38 and second spindle 41 as does switch 30 for first motor 36 and first spindle 40. The workpiece 80 is then manipulated in exactly the same procedure using spindle 41 as was done using spindle 40. Since the beveling abrasive 76 of spindle 41 is considerably finer textured than that of first spindle 40, the beveled surface 86 is finished to a uniform texture relative to its texture following grinding on spindle 40.

After the fine beveling step has been completed, the workpiece 80 is ready for lustering and polishing. At this point, the operator pushes switch 34 and thus activates the finisher motor 48. The operator then moves the workpiece 80 to the right rear of apparatus 10 and manually brings the beveled surface 86 of the workpiece 80 into contact with the spinning lustering wheel 52. The cork lustering wheel 52 is provided with an abrasive, usually pumice, which is of finer grade than that of spindle 41. Thus the contact between bevelled surface 86 and lustering wheel 52 further smooths the surface and makes it more uniform.

Once the entire beveled surface 86 has been finished by the cork lustering wheel 52, the operator moves the workpiece 80 to the spinning polishing wheel 54. The fabric, usually felt, surface of polishing wheel 54 removes the fine scrates from lustering which remain on the beveled surface 86 and provides a finish to the surface such that the texture is perfectly smooth and optically clear or transparent.

This invention may assume numerous variations and alternate embodiments from that specifically described herein. For example, it is possible to eliminate the edging abrasive 78 and provide instead a smooth sliding surface, or even a free spinning ring surface around edging ring section 62 such that there is no danger of chipping of the edge 84 of the workpiece 80 during the beveling operation. If this modification is made, the beveled surface 86 itself and the constant separation of the glass edge 84 and the bevel inner edge 88 will be maintained but no smoothing of the outer edge 84 will take place.

The preferred embodiment utilizes a base 12 and case 14 manufactured out of high-impact plastic. The table top 24 is ordinarily metal. The various electrical motors are designed to run off AC current and are selected to have power between $\frac{1}{4}$ and $\frac{3}{4}$ horsepower. The motors turn the beveling spindles at speeds up to 10,000 rpm. The usual wetting agent used in the preferred embodiment is water, although the addition of a small amount of chemical surfactant may be desirable for particularly smooth grinding.

Spindles 40 and 41, of systems heretofore built, have been constructed of steel with the surface abrasive 76 and 78 being diamond abrasives. The texture of each abrasive is selected by the operator depending on the desired degree of grinding. The grit (degree of abrasiveness) of the beveling abrasive 76 is typically "80" grit for a rough bevel and combination "400–600" grit for a fine bevel. The lustering wheel 52 utilizes commonly available abrasive materials and is typically of semi-coarse cork and pumice construction. Polishing wheel 54 is a standard item and is preferably selected to be a wheel of felt-like material coated with particulate cerium oxide (CeO). The cerium oxide may be periodically reapplied to the surface of the polishing wheel.

In constructing the apparatus 10 of the preferred embodiment, care should be taken that the table top surface 24 is perpendicular to the axis of the spindles 40 and 41. Such alignment is desirable to aid the operator in achieving a totally uniform bevel. It is also desirable to make certain that the table top surface 24 is completely flat, particularly in the areas adjacent to spindles 40 and 41. It is preferable also to reinforce the table top 24 or to construct it of particularly rigid material to avoid deformations in the panel surface caused by operator pressure on the workpiece 80 during the time the beveling process is being conducted by the operator.

Although the present invention has been described in terms of the presently preferred embodiment, it is to be understood that such disclosure is not to be interpreted as limiting. Accordingly, it is intended that the appended claims be interpreted as covering all alterations and modifications as fall within the true spirit and scope of the invention.

What is claimed is:

1. An apparatus for beveling glass or glass-like material comprising, in combination:

a flat rigid surface member supported above and parallel to the plane of the surface upon which the apparatus is situated for receiving and supporting a piece of material to be beveled, the flat rigid surface member having at least one aperture extending therethrough;

a beveling spindle projecting upward through each said aperture with its axis of rotation perpendicular to the plane of the flat surface member, the beveling spindle comprising an integrally formed member symmetrical about a vertical axis of rotation and including a flywheel ring section, a beveling cone section adjacent to said flywheel ring section, an edging ring section adjacent to said beveling ring section, a gripping ring section adjacent to said edging ring section and a stem section adjacent to said gripping ring section, the surfaces of said beveling cone section and said edging ring section being abrasive and together forming a grinding surface;

means for adjusting the relative height of each spindle with respect to the top of the flat surface; and means for causing each beveling spindle to rapidly rotate about its axis of rotation whereby as a piece of material is urged over the flat rigid member towards the axis of the spindle, the edge of the material intersects said grinding surface and is ground.

2. An apparatus for beveling glass as recited in claim 1 wherein each beveling spindle further includes a center bore formed therethrough about said axis of rotation.

3. An apparatus for beveling glass as recited in claim 1 wherein each beveling spindle further includes a splashguard ring section integrally formed adjacent to said flywheel ring section.

4. An apparatus for beveling glass as recited in claim 1 wherein an abrasive coating is bonded to the upper surface of said beveling cone section.

5. An apparatus for beveling glass as recited in claim 1 wherein an abrasive coating is bonded to the circumferential surface of said edging ring.

6. An apparatus for beveling glass as recited in claim 2 wherein said gripping ring section includes a radial aperture therethrough for receiving a set screw.

7. An apparatus for beveling glass as recited in claim 2 further including a planar base member; and front, left side, back and right side panels extending from the base to the flat surface to form a casing.

8. An apparatus for beveling glass as recited in claim 7 wherein the means for rotating each beveling spindle include an electric motor for each said spindle situated within said casing, each of said electric motors having a drive shaft coupled with the respective beveling spindle, said drive shaft being rapidly spun by said motor such that the beveling spindle rotates rapidly about its axis of rotation; and said drive shaft extends partially through said center bore of the beveling spindle to a position such that the top of said drive shaft is vertically aligned within said stem section.

9. An apparatus for beveling glass as recited in claim 8 wherein that portion of said center bore within said stem section is threaded; and said gripping ring section includes a radial aperture therethrough for receiving a set screw for locking the spindle to said drive shaft.

10. An apparatus for beveling glass as recited in claim 9 wherein the means for adjusting the relative height of each spindle with respect to the top of the flat surface member comprises an adjusting screw mated with said threaded portion of said center bore whereby said screw moves vertically therein when turned, said adjusting screw abutting against the top of said drive shaft whereby turning of said adjusting screw raises or lowers the spindle with respect to said drive shaft and said set screw is tightened to lock the relative positions of the beveling spindle and said drive shaft when the desired orientation is achieved.

11. An apparatus for beveling glass as recited in claim 7 and further comprising a motor mounted upon the exterior wall of said back panel at a position above the base, the motor including a rotatable shaft extending from the ends of the motor and being parallel to the planes of both the base and said back panel and having attached, at the respective ends of said rotatable shaft, a first abrasive wheel and a second abrasive wheel for lustering and polishing a glass surface.

12. An apparatus for beveling glass as recited in claim 11 wherein said first abrasive wheel is a cork and pumice lustering wheel; and said second abrasive wheel is a felt material coated with particulate cerium oxide.

13. An apparatus for beveling glass as recited in claim 11 and further comprising a safety shield mounted on said back panel extending above and partially over said motor and said first and second abrasive wheels.

14. An apparatus for beveling glass or glass-like material comprising, in combination:

a flat rigid surface for receiving and supporting a piece of material to be beveled, the flat rigid surface including at least one aperture extending therethrough;

a beveling spindle projecting upward through each said aperture with its axis of rotation perpendicular to the plane of the flat surface member, the beveling spindle further comprising an integrally formed member symmetrical about a vertical axis of rotation and including a flywheel ring section, a beveling cone section adjacent to said flywheel ring section, an edging ring section adjacent to said beveling ring section, a gripping ring section adjacent to said edging ring section, a stem section adjacent to said gripping ring section, a center bore formed through said sections to be collinear with and about said axis of rotation, an abrasive coating bonded to the upper surface of said beveling cone section and a radial aperture formed through said gripping ring for receiving a set screw, the surfaces of said beveling cone section and said edging ring section together forming a grinding surface;

means for adjusting the relative height of each spindle with respect to the top of the flat surface;

means for causing each beveling spindle to rapidly rotate about its axis of rotation whereby as a piece of material is urged over the flat rigid surface towards the axis of the spindle, the edge of the material intersects said grinding surface and is thereby ground; and means for selectively delivering a wetting agent to said grinding surface upon each of the beveling spindles.

15. An apparatus for beveling glass as recited in claim 14 wherein each beveling spindle further includes a splashguard ring integrally formed adjacent to said flywheel ring; and a runoff reservoir is situated within said casing under each spindle for receiving excess wetting agent.

16. An apparatus for beveling glass as recited in claim 14 wherein said abrasive coating bonded to said beveling cone section is a particulate suspension of diamond; and said edging ring has bonded to the circumferential surface thereof an abrasive comprising a particulate suspension of diamond.

17. An apparatus for beveling glass as recited in claim 14 further comprising a motor mounted upon the exterior wall of said back panel at a position above the base, the motor including a rotatable shaft extending from the ends of the motor and being parallel to the planes of both the base and said back panel and having attached, at the respective ends of said rotatable shaft, a first abrasive wheel and a second abrasive wheel for lustering and polishing a glass surface; and a safety shield mounted on said back panel extending above and partially over said motor and said first and second abrasive wheels.

* * * * *